United States Patent [19]

Mansfield et al.

[11] Patent Number: 4,557,787

[45] Date of Patent: Dec. 10, 1985

[54] AUTOMATICALLY CONTROLLED THERMO-CEMENTING AND FOLDING MACHINE

[75] Inventors: Graham J. Mansfield; Dennis S. Hall; Ewen R. Cameron, all of Leicester, England

[73] Assignee: USM Corporation, Farmington, Conn.

[21] Appl. No.: 554,558

[22] Filed: Nov. 23, 1983

[30] Foreign Application Priority Data

Nov. 24, 1982 [GB] United Kingdom ..... 8233504

[51] Int. Cl.[4] ..... B05C 5/00

[52] U.S. Cl. ..... 156/356; 12/1 R; 118/683; 156/443; 156/461

[58] Field of Search ..... 156/356, 357, 443, 461, 156/468; 118/683, 672; 12/1 R

[56] References Cited

U.S. PATENT DOCUMENTS 3,167,452 1/1965 Lineback ..... 118/683
3,728,985 4/1973 Dunlap et al. ..... 118/683
4,249,478 2/1981 Gruener ..... 118/683 X
4,431,690 2/1984 Matt et al. ..... 118/683 X

FOREIGN PATENT DOCUMENTS 1452969 10/1976 United Kingdom .

*Primary Examiner*—David Simmons
*Attorney, Agent, or Firm*—William F. White

[57] ABSTRACT

In a thermo-cementing and folding machine, a gear pump operates to supply adhesive at a rate which is dependent upon the speed of rotation of a main drive shaft, by which workpiece feeding means of the machine is driven. The machine has also a facility for varying the rate of feed of a workpiece by the workpiece feeding means without varying the speed of rotation of the main drive shaft. The ratio of the rotational speed of the shaft to the operating rate of the pump is varied in response to variation of the workpiece feed rate. This arrangement is achieved by computer control, the gear pump being driven by a stepping motor for this purpose. In addition, at the end of each work cycle, use of a stepping motor facilitates "suck back" of adhesive, and a "fast forward" adhesive upon initiation of the next work cycle.

10 Claims, 2 Drawing Figures

MI
E
S5
R
C
RAM
CPU
DB
EPROM
D
I/P
ADC
I/O B
O/P
TS1
TS2
TS3
VR4
VR5
VR6
S4
S6
S7
S8
H1
H2
H3
M
SMD
SOL1
SOL2
RL1

AUTOMATICALLY CONTROLLED THERMO-CEMENTING AND FOLDING MACHINE

FIELD OF THE INVENTION

This invention is concerned with thermo-cementing and folding machines comprising a main drive shaft, folding instrumentalities arranged at an operating locality of the machine and including a creaser foot over which a marginal portion of a workpiece can be turned, adhesive supply means by which adhesive can be supplied, through a passage in the creaser foot, to the marginal portion of a workpiece being turned thereover, workpiece feeding means operable in timed relation with rotation of the main drive shaft for feeding a workpiece through the operating locality, and means for varying the rate at which such workpiece is fed, without varying the speed of rotation of the main drive shaft, wherein the rate at which adhesive is supplied to the workpiece marginal portion can be modified in response to variation in the workpiece feed rate.

BACKGROUND OF THE INVENTION

One such machine is described in UK patent specification No. 1452969. In this machine the adhesive supply means comprises a ratchet-operated gear pump for supplying adhesive through the creaser foot, the ratchet being carried by an oscillating rod arrangement, said rod arrangement being connected to the workpiece feeding means, so that the speed of oscillation is determined by the speed of rotation of the main drive shaft. The connection with the workpiece feeding means, furthermore, is such that any variation of the rate at which the workpiece is fed, under the control of the workpiece feed rate varying means, is effective to vary also the amplitude of the oscillation of the rod arrangement, and thus the distance through which the gear pump is rotated under the action of the ratchet.

It will be appreciated that, by using a ratchet-operated gear pump, the supply of adhesive is necessarily intermittent and can take place only during certain parts of each cycle of the machine (i.e. of each rotation of the main drive shaft). While admittedly the workpiece feeding means conventionally also is operated intermittently, nevertheless problems may arise when adhesive is applied to the workpiece marginal portion in a series of blobs, rather than in the form of a continuous ribbon.

One problem frequently encountered in thermo-cementing and folding machines, furthermore, is the tendency for adhesive to "drool" from the creaser foot during the period between successive operations. Various solutions to this problem have been attempted; for example, in the machine described in the aforementioned Patent Specification, it is proposed to provide an on-off valve associated with the gear pump outlet, this valve being operated by the oscillating rod arrangement, through a Bowden cable. In machines of other types, however, one solution to the problem of drool has been to provide a so-called "suck back" arrangement, whereby adhesive is drawn away from the outlet port; one such arrangement, utilised when the adhesive is supplied in rod form, operates to withdraw the leading end of the solid rod in a direction away from the melt chamber so that back-suction is applied to the molten adhesive to draw it away from the exit nozzle or port.

It will of course be appreciated that, in the machine described in the aforementioned Patent Specification, because of the direct connection between the gear pump drive and the workpiece feeding means, such a suck back arrangement is not possible.

Also where a suck back arrangement is provided, it is, it will be appreciated, also at least highly desirable, if not necessary, to feed the adhesive at a fast forward rate in order to ensure that the supply of adhesive is immediately available when required at the start of the next operation. Where the arrangement for retracting the adhesive in rod form is utilised as set out above, the rod is then advanced through the same distance at the start of the next operation to provide this forward "spurt". Conventionally this is achieved by the rod feed mechanism itself being bodily moved towards and away from the melt chamber. However, in practice, it has been found that it is frequently not adequate merely to advance the rod through the distance through which it has been retracted, but that rather it would be desirable to advance the rod feed mechanism through a greater distance than that through which it had previously been retracted.

It will of course be appreciated that where, again, the adhesive supply is controlled by a gear pump directly connected to the workpiece feeding means, the possibility for a "fast forward" adhesive supply over a short period at the start of an operating cycle is not readily attainable.

OBJECT OF THE INVENTION

It is thus the object of the present invention to provide an improved thermo-cementing and folding machine in which the control of the adhesive supply is rendered more versatile, and in particular the control of deposition of adhesive is enhanced and further "suck back" and "fast forward" functions can be incorporated.

SUMMARY OF THE INVENTION

The invention thus provides a thermo-cementing and folding machine comprising a main drive shaft, folding instrumentalities arranged at an operating locality of the machine and including a creaser foot over which a marginal portion of a workpiece can be turned, adhesive supply means by which adhesive can be supplied, through a passage in the creaser foot, to the marginal portion of a workpiece being turned thereover, workpiece feeding means operable in timed relation with rotation of the main drive shaft for feeding a workpiece through the operating locality, and means for varying the rate at which such workpiece is fed, without varying the speed of rotation of the main drive shaft, the arrangement being such that the rate at which adhesive is supplied to the workpiece marginal portion can be modified in response to variation in the workpiece feed rate, wherein the adhesive supply means comprises a gear pump driven by an n.c. motor in response to drive signals which are supplied thereto in timed relation with the rotation of the main drive shaft, but the incidence of which is modified according to the operational state of the workpiece feed rate varying means.

By the phrase "n.c. motor", where used herein, is to be understood a motor the operation of which is controlled by control pulses supplied thereto in accordance with digitised information appropriate to the desired operation of the motor. Examples of such motors are stepping motors and d.c. servo motors.

It will be appreciated that, by utilising a gear pump driven by an n.c. motor as aforesaid a much more versatile control system is thereby achieved, and in particular the dependence of the modification of the operation of the gear pump upon certain mechanical functions of the machine can be dispensed with, while the desired modification is nevertheless achieved. Furthermore, by no longer tying the operation of the gear pump to the mechanical functions referred to, the operation of the gear pump can be controlled in different operating modes (e.g. to achieve suck back and fast forward motions) without difficulty.

The invention is especially appropriate to a machine in which the workpiece feeding means comprises an orbitally operating hammer-and-anvil arrangement by which a workpiece is fed intermittently past the folding instrumentalities, and wherein said workpiece feed rate varying means comprises feed length varying means for varying the distance through which a workpiece is fed in an orbital cycle of said arrangement, means being provided for varying the incidence of the drive signals when the feed length varying means is operated. From this, it will be apparent that, where separate feed speed varying means and feed length varying means are provided, the incidence modifying means may be tied into the operation of the feed length varying means.

More particularly, in the operation of the machine in accordance with the invention, conveniently the incidence modifying means operates to reduce the rate of operation of the gear pump to a pre-determined proportion, upon operation of the feed length varying means to reduce the distance through which a workpiece is fed in each orbital cycle of the hammer-and-anvil arrangement, and to restore the rate of operation of the gear pump when the feed length varying means is operated to increase such distance. This recognises that it will not normally be necessary for the reduction of the rate of operation of the gear pump to be to a proportion which is in a fixed relationship with the variation with feed length, although if desired, the proportion to which the rate of operation of the gear pump is reduced as aforesaid may be so tied in.

For controlling the operation of the gear pump as aforesaid, preferably a shaft encoder is associated with the main drive shaft and in response to each pulse emitted by the encoder a signal having a pre-determined value or a proportionately reduced value, according to the operational state of the workpiece feed rate varying means (or feed length varying means), is "read" by a computer and the n.c. motor is supplied with drive signals according to the cumulative value of the signals "read" by the computer in response to the pulses emitted by the encoder.

Of course, in some conditions, it may be desirable not to modify the rate of supply of adhesive during the operation of the machine, and to this end, switch means may be provided for enabling/disabling the incidence modifying means.

In a preferred form of the invention, furthermore, at the end of an operating cycle, the gear pump is caused to operate in a reverse direction, independently of the rotation of the main drive shaft, through a pre-determined distance, whereafter it is brought to rest, and similarly, at the start of an operating cycle, the gear pump is caused to operate in a forward direction at high speed, independently of the rotation of the main drive shaft, through a per-determined distance, whereafter it continues to operate in timed relation with rotation fo the main drive shaft as aforesaid. It will thus be appreciated that, in this way, a "suck back" and "fast forward" arrangement is readily achieved.

Furthermore, in one embodiment of the invention the pre-determined distance through which the gear pump is caused to operate in a reverse direction is the same as that through which it is caused to operate at high speed in a forward direction; on the other hand, in other embodiments it may be desired that these two distances are different, and in particular that the "forward direction" is proportionately greater than the "reverse direction" distance.

In order to control the suck back function, furthermore, preferably operator-control means is provided for setting the pre-determined distance through which the gear pump is caused to operate in a reverse direction. In this way, the operator may set the suck back according to e.g. the viscosity of the adhesive.

BRIEF DESCRIPTION OF THE DRAWINGS

There now follows a detailed description, to be read with reference to the accompanying drawings, of one machine in accordance with the invention. This machine, it will be appreciated, has been selected for description merely by way of exemplification of the invention and not by way of limitation thereof.

In the accompanying drawings.

DESCRIPTION OF THE PREFERRED EMBODIMENT

Figure 1:
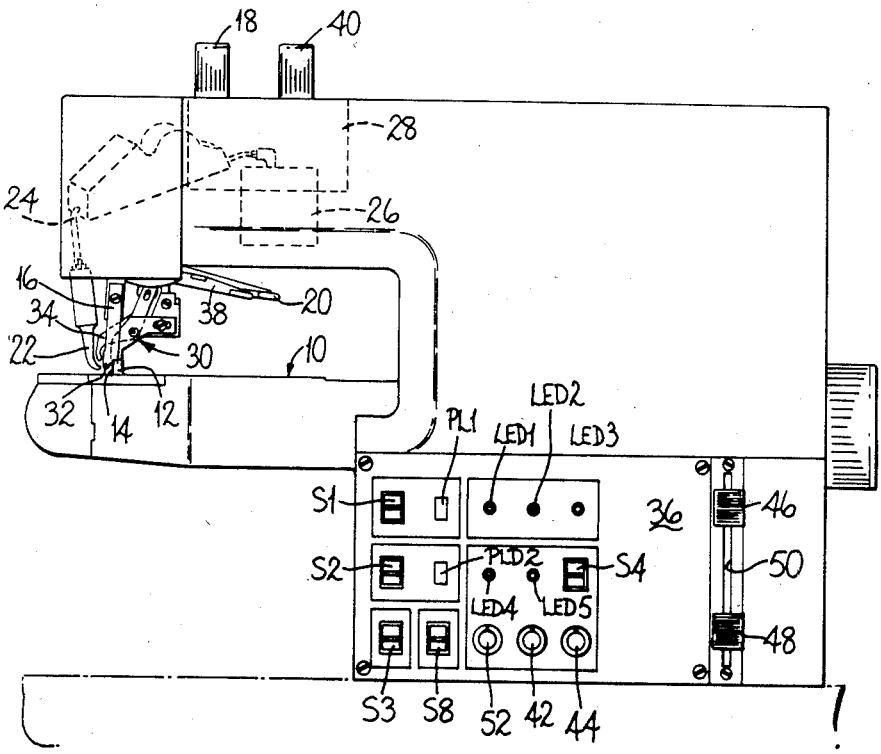
FIG. 1 is a front view of the machine to be described.

The machine now to be described is a so-called thermo-cementing and folding machine, which finds use in the shoe industry and allied trades, where it is desired to fold the edge of the workpiece over on itself and secure it in a folded condition. To this end, the machine comprises a work table 10 on which is supported a block 12 having a work-guiding surface 14 which curves upwardly, out of the plane of the work table 10, so as to provide a smooth fold-initiating surface for a workpiece the edge of which is to be folded. For limiting the movement of the workpiece edge of the surface 14, a gauge finger 16 is provided which is adjustable heightwise by means of an adjustment knob 18. For raising the gauge finger 16 out of its operative position, furthermore, a manually operable lever 20 is provided.

For assisting in the formation of a fold, furthermore, a creaser foot 22 is mounted with its end adjacent the block 12. The creaser foot has a central passage through which hot-melt adhesive can be fed, the foot having an outlet through which adhesive can be fed on to the central region of the part of the workpiece to be folded. The passage in the creaser foot is supplied through a delivery tube 24 which is connected "upstream" to a gear pump 26 which in turn is fed from a melt chamber 28. Because the adhesive is a hot-melt, the melt chamber 28, delivery tube 24 and creaser foot 22 are each provided with a separate heater, respectively H1, H2 and H3, of the electric cartridge type. The delivery tube, furthermore, is clad with appropriate thermal insulation.

For moving the creaser foot 22 out of its operative position a manually operable lever 38 is provided, which together with the lever 20, thus facilitates the introduction of a workpiece to the operating locality of the machine. The heightwise position of the creaser foot 22 is adjustable by an adjustment knob 40.

The machine, as so far described above, is conventional. Furthermore, also as is conventional, the machine comprises a snipping knife arrangement generally designated 30 and comprising a fixed blade 32 and a movable blade 34 mounted on the fixed blade, the blades being so arranged, "downstream" of the block 12, that they can cut the upstanding edge portion of the workpiece which is supported by the block 12. In general, the snipping knife arrangement 30 is used where the edge of the workpiece defines a so-called "inside" curve.

For feeding a workpiece past the block 12 and the creaser foot 22, and also for completing and consolidating the fold, a work feed arrangement is provided comprising a hammer-and-anvil (not shown) which are moved orbitally, the arrangement being such that over a given part of the orbit, the hammer-and-anvil trap the workpiece therebetween as they move rearwardly over a given distance (feed length) and at a given speed (feed speed). The hammer-and-anvil are driven through a main drive shaft (not shown) of the machine, by means of an electric motor (not shown) through a clutch. The motor speed, and thus the feed speed, is controlled by a first treadle (not shown); a second treadle (also not shown) also is provided for operating two switches S6, S7, the arrangement being such that only one of said switches can be operated at any one time. Switch S6 is effective to reduce the feed length, which thereby causes pleating of the folded over margin of the workpiece (and is thus especially useful on sharp so called "outside" curve). For controlling the feed length, "maximum" and "minimum" stops 46, 48 are provided, said stops being arranged to project through an appropriate slot 50 in the control panel to facilitate operator setting thereof. Switch S7 is effective to cause the snipping knife arrangement 30 to operate.

For switching the supply of adhesive on and off, a main switch S4 is provided on a control panel 36 of the machine, and, for controlling the supply of adhesive during the operation of the machine, a knee-operated switch S5 is provided.

The control panel 36 of the machine has, in addition to the main "adhesive supply" switch S4, a mains on-off switch S1 and a motor on-off switch S2. Mains power is thus supplied to two solenoids SOL1, SOL2 and to heaters H1, H2, to be referred to hereinafter, and also to a transformer (not shown) which steps down the voltage to 12 volts. A 12 V a.c. supply is thus supplied to a work lamp (not shown) which can be switched on by switch S3, also on the control panel 36. In addition, this circuit supplies power to a further heater H3. From this 12 V a.c. circuit, furthermore, is derived an unsmoothed 12 volt d.c. circuit which supplies power to a mains-controlled control box MI supplying a "mains interrupt" signal to be referred to hereinafter. In addition, there is derived from the 12V a.c. circuit a smoothed 12V d.c. circuit which supplies power to an n.c. motor M (in casu a stepping motor), which will be referred to hereinafter. From the smooth 12V d.c. circuit, furthermore, is derived a 5V circuit, which drives a central processor unit (CPU) and circuits, and supplies power to switches S4, S5, S6 and S7 thermisters TS1, TS2, TS3 and potentiometers VR4, VR5 and VR6, each of which will be referred to hereinafter.

The control panel 36 also is provided with various indicator devices, including a light-emitting diodes LED 1, LED 2 and LED 3, associated respectively with heaters H1, H2 and H3, and LED 4 and LED 5, associated respectively with an "adhesive supply" circuit and with the knee-operated switch S5, also as to be described in detail later.

As already mentioned, switches S6 and S7, which are operated under the control of the second treadle of the machine, cannot be operated simultaneously, the one switch being operated by depression of the toe of the operator on the treadle, and the other by depression of his or her heel. In some cases, however, it is desirable that snipping should take place while the feed length is reduced, and to this end a further control switch S8 is provided on the control panel 36 which is effective, in combination with switch S6, to cause snipping to take place simultaneously with the reduced feed length.

Figure 2:
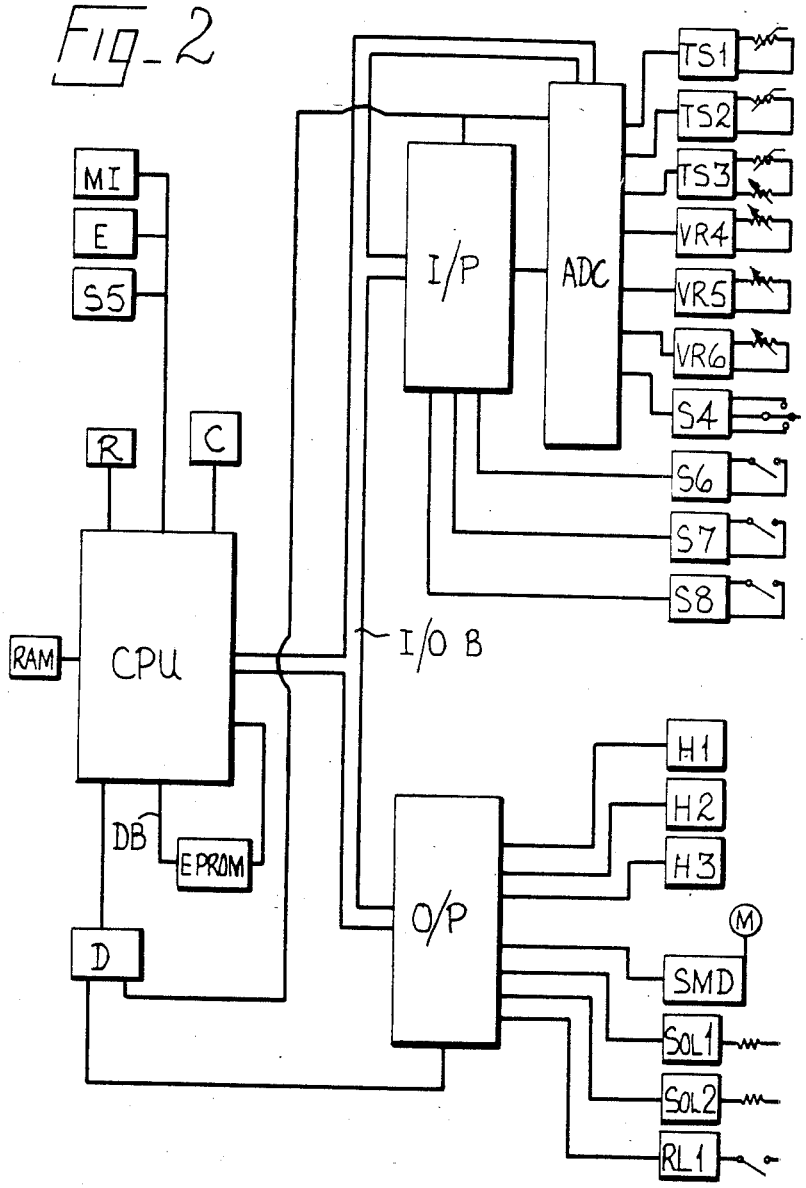
FIG. 2 is a block diagram of an electronic control circuit of said machine.

The machine in accordance with the invention is computer-controlled and comprises a central processor unit (CPU) in the form of a single chip 8-bit micro-computer (in casu, a Zilog Z8681 which, in addition to a micro-processor, also incorporates a random access memory (RAM) (shown separately in FIG. 2) and scratch pad; this micro-computer is obtainable from Zilog Inc.). For the internal timing of the CPU a system clock C, comprising a free-running 8 MHZ crystal, is provided.

The CPU is connected via I/O bus I/OB with input and output ports IP, OP and via a memory address and data bus DB with a non-volatile memory in the form of an EPROM (erasable programmable read-only memory), which is accessed by the CPU via the data bus DB for instructions to execute. A conventional decoder D is also provided for controlling the functioning of the input and output ports IP, OP.

The control circuit also includes an analogue-to-digital convertor (ADC) to which signals are supplied by the potentiometers VR4, VR5, VR6, thermisters TS1, TS2, TS3, and switches S4, S8. The ADC is interrogated by the CPU, by the I/O bus, each time a mains interrupt signal is supplied to the CPU by the control box MI. More particularly, the various channels of the ADC are interrogated in turn, one in response to each mains interrupt in a so-called "wrap around" sequence. The ADC, in response to a signal from the decoder D, supplies information as to the state of the interrogated channel via the input port IP.

Also supplying information via the input port in response to an enabling signal from the decoder D, are switches S6, S7, while switch S5 provides a direct "interrupt" signal to the CPU.

The electronic control circuit also comprises a re-set sub-circuit R by which, upon starting up of the machine, the CPU is enabled to set the controls to their correct state in a rapid manner. This sub-circuit R is directly connected into the CPU for this purpose.

A further, direct, "interrupt" input is provided to the CPU from a shaft encoder E which is driven by the main drive shaft of the machine. The shaft encoder E is conveniently a disc having a plurality of (in casu sixteen) equally spaced notches, with which are aligned two opto-switches operating through a flip-flop (set re-set) to supply pulses to the CPU. The switches are spaced apart from one another by a distance more than the width of a notch, so that if, for example, the main drive shaft is arrested in a position in which the edge of a notch is aligned with one of the switches, any vibration of the disc, e.g. caused by vibrations of the machine, will not result in the generation and supply to the central processing unit of a series of pulses, but rather that switch, having once emitted a pulse, will be disabled until the flip-flop is re-set by the other switch having been actuated.

In response to the various signals thus supplied to the CPU, the CPU supplies outputs, via output port OP, to sub-circuits controlling the heaters H1, H2, H3, to subcurcuits controlling the solenoids SOL1, SOL2, to motor drive SMD and to the various LEDs referred to above.

Dealing now more specifically with particular features of the invention, the n.c. motor M is operatively connected to the gear pump 26 and serves to control the rate of feed of adhesive through the adhesive-supply system.

To this end, switch S4, which is a three-position switch, is provided for manually switching the adhesive supply system on and off; the third position will be referred to later. Switch S4 is an overall control for switching at the start and finish of a working shift. In addition, knee-operated switch S5 is provided for switching the system on and off in each working cycle. Both switches S4, S5 serve, through the CPU, to switch motor M on and off.

The operating speed of the motor M is controlled by the shaft encoder E, as will now be described. Thus, in response to each pulse generated by the shaft encoder E, a digital "increment" value is added to an accumulator stored in the RAM of the CPU. This increment value is determined by an operator setting of the potentiometer VR4, which is provided with an adjustment knob 42 on the control panel 36 for this purpose. The potentiometer VR4 forms part of a metering circuit which supplies a signal through the ADC to the CPU. The range of adjustment of the potentiometer VR4 corresponds to a range of ratios of rotation of the main drive shaft to rotation of the motor M. In the machine described, the range of ratios is approximately 40:1 to 400:1 and this range of ratios corresponds to an output from the ADC of 255 to 0 (FF to 0 hex). The value of the signal from the ADC constitutes the increment value. The accumulator adds the increment value to the accumulated total in response to each pulse from the shaft encoder, and each time the accumulator "overflows", the motor M receives a drive pulse; in the case of a stepping motor, it is stepped through one step.

It will thus be appreciatd that, by altering the position of adjustment knob 42, the rate of feed of adhesive in relation to the rotational speed of the shaft can be adjusted by the operator.

In a thermo-cementing and folding machine, as mentioned above, it is sometimes desirable to reduce the feed length, irrespective of the feed speed, in order to steer round "outside" curves. To this end, as is conventional, solenoid SOL1 is provided which switches the feed length between maximum and minimum as determined by the stops 46, 48, referred to above. More particularly, as is conventional, the solenoid SOL1 serves to cause the geometry of a linkage system to be so varied as to consequently vary also the distance through which the hammer-and-anvil move in feeding the workpiece. In the machine in accordance with the invention, solenoid SOL1 is operated by actuation of treadle-operated switch S6.

Reducing the feed length is of course effective to reduce the rate at which the workpiece is fed through the machine, but without reducing the feed speed, as measured at the main drive shaft, so that the amount of adhesive fed is not generally affected by a reduction of feed length. This can lead to excessive adhesive being supplied, which adhesive may of course be squeezed from beneath the fold, leaving an unsightly amount of adhesive visible in the finished workpiece. To overcome this problem therefore, a "metering modify" circuit is provided which supplies an appropriate signal through the input port. This circuit operates in combination with the "metering" circuit and with the circuit incorporating the switch S6 so that, upon operation of the switch S6, the increment value referred to above is reduced, thereby reducing the frequency of "overflow" of the accumulator, and thereby increasing the ratio between the main drive shaft and the output shaft of the motor M. It has been found that a reduction of 50% of the increment value is appropriate when operating with reduced feed length.

For enabling the "metering modify" circuit, switch S4 is provided with contacts which are closed when in its third position. Of course, in the third position, the adhesive supply is still switched "on".

At the end of an operating cycle of the machine, it is regarded as desirable to avoid drooling of the adhesive from the passage in the creaser foot 22. This is achieved conventionally by a "suck back" arrangement. In the machine in accordance with the invention, "suck back" is achieved by reversing the direction of rotation of the motor M through a pre-determined distance. This takes place independently of the rotation of the main drive shaft. Conveniently, this reversing of the motor drive takes place upon operation of the knee-operated switch S5, the main function of which is to cause the supply of adhesive to be terminated. Furthermore, in the machine in accordance with the invention, the amount of "suck back" can be adjusted by the operator and to this end the potentiometer VR5 is provided in a "suck back setting" circuit, the potentiometer having an adjustment knob 44 on the control panel 36. As already mentioned, the "suck back setting" circuit supplies a signal through the ADC so that the pre-determined distance can be varied according to operator preference. In the particular case, where a stepping motor is used to drive the gear pump 26, a range of 0 to 128 steps in the reverse direction has been found to be suitable, and the ADC serves to provide a "suck back" value in the range of 0 to 255 (0 to FF hex) in response to the setting of the potentiometer VR5.

In order, furthermore, to avoid a deficiency of adhesive at the start of the next following machine cycle, the motor M driving the gear pump 26 is actuated, upon actuation of the knee-operated switch S5, and operates through a pre-determined distance at a fast speeed. The pre-determined distance may be the same as the "suck back" distance, or, if desired, may be a proportion (whether greater or smaller) of that distance. The adhesive sucked back in the preceding machine cycle is thus restored at the start of each machine cycle. It is to be noted that, in order to prevent accidental switching on of the adhesive when the machine is not operating, the operation of the gear pump 26 at a fast speed is enabled as aforesaid only if the main drive shaft is rotating. More especially, the "fast speed" operation of the pump is initiated only after two pulses have been generated by the shaft encoder E.

As is also conventional in thermo-cementing and folding machines, the operation of the snipping knife arrangement 30 is controlled by solenoid SOL2, which is operated upon actuation of the treadle-operated switch S7.

As already mentioned above, switches S6 and S7 cannot be operated simultaneously under the control of the treadle. In some cases, however, it is desirable that snipping should take place while the feed length is reduced. To this end, therefore, control switch S8 is provided, actuation of which is effective, when switch S6 is also actuated to cause snipping to take place simultaneously with the reduced feed length; that is to say, actuation of switch S8 causes solenoid SOL2 to be energised when switch S6 is actuated.

When the machine is switched on at the start of a working shift, the CPU is first enabled and ensures that any incorrect settings of the various operating elements are corrected. Thereafter, signals are supplied via the ouput port OP to heaters H1, H2 and H3, which respectively supply heat to the melt chamber 28, delivery tube 24 and creaser foot 22. Because the construction of the various elements, it is likely that the creaser foot 22 will heat up considerably more rapidly than the melt chamber 28, while the delivery tube 24 will heat more rapidly than the melt chamber but less rapidly than the creaser foot. Consequently, initially only the heater H1 for the melt chamber 28 is switched on. The heater H2 for the delivery tube 24 is then switched on at a pre-determined stage in the heating up of the melt chamber, and finally the heater H3 for the creaser foot 22 is switched on at a pre-determined stage in the heating up of the delivery tube.

For sensing the temperature of the melt chamber thermistor TS1 is provided, incorporated in a sub-circuit by which a signal is supplied to the ADC, which converts the signal to a numerical value between 255 and 0 (FF hex and 0). The switching on of the heater H2 for the delivery tube 26 takes place when the value of the ADC output reaches a pre-determined number. Similarly, the temperature of the delivery tube 24 is also sensed by thermistor TS2, incorporated in a sub-circuit identical with that for the melt chamber, and at a given numerical value, the heater H3 for the creaser foot is switched on. In the case of both heaters H1, H2, a "target" temperature is pre-set and cannot be varied by the operator. The temperature control sub-circuit operate, once the target temperature has been achieved, to maintain the temperature at the target, in a manner described below.

The temperature of the creaser foot is also sensed by thermistor TS3, incorporated in a sub-circuit which is generally similar to the aforementioned sub-circuits, but which also includes potentiometer VR6, having an adjustment knob 52 on the control panel. The maximum resistance of the potentiometer VR6 is relatively small in relation to that of the thermistor TS3, but is sufficient to enable the temperature of the creaser foot to be varied over a range of some 20°, at the level of temperatures at which it is expected the machine will normally operate; the normal temperature range would be expected to be within approximately 130° to 150° C.

For maintaining the temperatures at the "target", a programme stored in the EPROM establishes a band of numerical values extending at either side of the target value, this band representing a band of temperatures at either side of the target temperature. When the numerical value as sampled lies within the band, the appropriate duty cycle for the heaters over the next time interval (determined by the mains interrupt) is calculated; more specifically, the difference between the actual and target temperatures is calculated and, depending upon this difference, a proportion of the time interval is determined during which the heater is to be switched on, and appropriate instructions are issued, which are then executed during the time interval. Thus, for example, if the target value is almost achieved, the programme could calculate that the heater need be switched on for only 55% of the time interval, in which case after 55 main interrupts, the heater will be switched off for the remainder of that time interval.

It will thus be appreciatd that, especially once the target value has been achieved, maintenance of the target temperature is much more accurately achieved than would be the case with a conventional thermostatic device.

During the heating up period, LED4 on the control panel 36 flashes to indicate that heating up is taking place. When the target temperatures in all three areas have been achieved, LED4 is constantly illuminated.

If, after the heating up period, the numerical value corresponding to the temperature of any heater is observed to have moved outside the band, and if it remains so for a pre-determined number of (in casu ten) consecutive interrogations, a warning signal is supplied to an appropriate one of the three light-emitting diodes LED1, LED2, LED3, which, as mentioned above, are associated respectively with the heaters H1, H2, H3. In the event that the fault has arisen as a consequence of the corresponding thermistor entering an "open circuit" condition, in which condition it will of course supply a permanent maximum signal (FF hex) to the ADC, the appropriate LED will flash. In such a case, furthermore, in order that the operator can continue to use the machine for a limited period, e.g. in order to finish a batch of work being operated upon, even though the monitoring of the performance of the heaters is no longer being correctly carried out, while at the same time ensuring that the machine will not be damaged by continued use, once a malfunction of the thermistor is detected, the machine will continue to operate for a further pre-determined period (in casu ten minutes), during which period a 50% duty cycle is implemented for the heater associated with the malfunctioning thermistor. That is to say, during each time interval the heater will be switched on and off for equal proportions.

At the end of the pre-determined period, the CPU instructs a relay RL1 to drop out, whereby the mains power supply is cut off and thus the machine operation is terminated and all the heaters are de-energised.

The diodes LED1, LED2, LED3 are also used to diagnose any "heater channel" failures, in which case the appropriate LED is constantly illuminated. Such failures include failure of the heating elements and of the triacs controlling the heater elements, and also if one of the thermistors falls out of or is removed from the pocket in which it is to be located. In such circumstances, the warning is indicated when the numerical value moves outside the band (and in this case the observed change in signal is likely to take place more slowly than in the case of a thermistor going into "open circuit" condition—which feature of course is utilised to distinguish between the failure of the sensing circuit and that of the heater circuit or heater control circuit). If thereafter the change in numerical value continues to take place away from the target value, an "interlock" signal is supplied by the thermistor, causing the power supply to the machine to be switched off, again by relay RL1 dropping out.

The relay RL1 also serves as a general "watch dog" over the whole of the control circuit. To this end, it is maintained in a "made" condition during normal operation of the machine by a control sub-circuit which is "refreshed" at regular intervals, failure to refresh the sub-circuit causing the relay RL1 to drop out. More particularly, the sub-circuit receives a signal at each mains interrupt, the signal serving to change the state of the circuit between "1" and "0", the arrangement being such that switching to the "1" state constituting the "refresh" signal. The sub-circuit is arranged to become de-energised, in the absence of a refresh signal, after a time interval which is greater than the interval between two "1" signals. De-energisation of the sub-circuit of course switches off the relay, thereby terminating the power supply to the machine.

We claim:

1. A thermo-cementing and folding machine comprising a main drive shaft, folding instrumentalities arranged at an operating locality of the machine and including a creaser foot over which a marginal portion of a workpiece can be turned, workpiece feeding means operable in timed relation with rotation of the main drive shaft for intermittently feeding a predefined length of the workpiece through the operating locality, and means for varying the predefined length of workpiece being fed, without varying the speed of rotation of the main drive shaft, and adhesive supply means by which adhesive can be supplied, through a passage in the creaser foot, to the marginal portion of the workpiece being turned thereover wherein the adhesive supply means comprises a gear pump driven by an n.c. motor in response to drive signals which are supplied thereto in timed relation with the rotation of the main drive shaft, but the incidence of which is modified according to the operational state of the means for varying the predefined length of workpiece being fed whereby the rate at which adhesive is supplied to the workpiece marginal portion can be modified in response to variation in the predefined length of workpiece being fed.

2. A machine according to claim 1 wherein the workpiece feeding means comprises an orbitally operating hammer-and-anvil arrangement by which a workpiece is fed intermittently past the folding instrumentalities, and said means for varying the predefined length of workpiece being fed comprises feed length varying means for varying the distance through which a workpiece is fed in an orbital cycle of said arrangement and further wherein means is provided for modifying the incidence of the drive signals as aforesaid when the feed length varying means means is operated.

3. A machine according to claim 2 wherein the incidence modifying means operates to reduce the rate of operation of the gear pump to a pre-determined proportion, upon operation of the feed length varying means to reduce the distance through which a workpiece is fed in each orbital cycle of the hammer-and-anvil arrangement, and to restore the rate of operation of the gear pump when the feed length varying means is operated to increase such distance.

4. A machine according to claim 3 characterised in that said pre-determined proportion is 50%.

5. A machine according to any one of claims 2 to 4 characterised by switch means for enabling/disabling the incidence modifying means.

6. A machine according to claim 1 wherein a shaft encoder is associated with the main drive shaft and in response to each pulse emitted by the encoder a signal having a pre-determined value or a proportionately reduced value, according to the operational state of the means for varying the predefined length of workpiece being fed is "read" by a computer which causes drive signals to be supplied to the n.c. motor according to the cumulative value of the signals "read" by the computer in response to the pulses emitted by the encoder.

7. A machine according to any one of claims 1 to 4 wherein switch means is provided upon actuation of which the gear pump is caused to operate in reverse direction, independently of the rotation of the main drive shaft, through a pre-determined distance, whereafter it is brought to rest.

8. A machine according to claim 7 wherein upon re-actuation of said switch means the gear pump is caused to operate at high speed, independently of the rotation of the main drive shaft, through a pre-determined distance in a forward direction, whereafter it continues to operate in dependence upon the speed of rotation of the main drive shaft.

9. A machine according to claim 8 wherein the predetermined distance through which the gear pump is caused to operate in a reverse direction is the same, or substantially the same, as the pre-determined distance through which it is caused to operate at high speed in a forward direction.

10. A machine according to claim 7 wherein operator-actuatable means is provided for setting the predetermined distance through which the gear pump is caused to operate in a reverse direction.

* * * * *